US007681342B2

(12) United States Patent
Choi

(10) Patent No.: US 7,681,342 B2
(45) Date of Patent: Mar. 23, 2010

(54) INDUCTION IRONING APPARATUS AND METHOD

(76) Inventor: Lung Wai Choi, Block A & C, 2/F, Gee Chang Industrial Building, 108 Lok Shan Road, Tokwawan, Kowloon, Hong Kong (CN)

( * ) Notice: Subject to any disclaimer, the term of this patent is extended or adjusted under 35 U.S.C. 154(b) by 134 days.

(21) Appl. No.: 11/539,812

(22) Filed: Oct. 9, 2006

(65) Prior Publication Data

US 2007/0256336 A1 Nov. 8, 2007

Related U.S. Application Data

(60) Provisional application No. 60/797,678, filed on May 5, 2006, provisional application No. 60/800,050, filed on May 15, 2006.

(51) Int. Cl.
*D06F 75/14* (2006.01)
*D06F 75/22* (2006.01)
*D06F 75/38* (2006.01)

(52) U.S. Cl. ..... 38/77.5; 38/82; 38/88

(58) Field of Classification Search ..... 38/88, 38/140, 107, 77.5, 77.1, 82, 90; 219/618, 219/254, 246
See application file for complete search history.

(56) References Cited

U.S. PATENT DOCUMENTS

| | | | | | |
|---|---|---|---|---|---|
| 2,133,494 | A | * | 10/1938 | Waters | 219/618 |
| 2,332,468 | A | * | 10/1943 | Lofgren | 219/254 |
| 2,449,318 | A | * | 9/1948 | Pitman et al. | 219/246 |
| 2,487,292 | A | * | 11/1949 | Aske | 38/107 |
| 2,507,964 | A | * | 5/1950 | Duff | 219/770 |
| 2,817,169 | A | * | 12/1957 | Schott | 38/77.1 |
| 3,071,878 | A | * | 1/1963 | Beasley | 38/15 |
| 3,230,648 | A | * | 1/1966 | Ravasi et al. | 38/88 |
| 3,824,719 | A | * | 7/1974 | Miranker | 38/77.3 |
| 3,989,916 | A | | 11/1976 | Amagami et al. | |
| 4,268,737 | A | * | 5/1981 | Paschakarnis et al. | 219/618 |
| 4,820,891 | A | | 4/1989 | Tanaka et al. | |
| 5,721,418 | A | * | 2/1998 | Hazan et al. | 219/257 |
| 5,802,749 | A | * | 9/1998 | Barmentlo et al. | 38/82 |
| 5,954,984 | A | | 9/1999 | Ablah et al. | |
| 6,009,645 | A | * | 1/2000 | Shimizu et al. | 38/77.5 |
| 6,035,563 | A | * | 3/2000 | Hoefer et al. | 38/77.1 |
| 6,384,387 | B1 | | 5/2002 | Owens et al. | |
| 6,504,135 | B2 | | 1/2003 | Clothier et al. | |
| 6,894,255 | B2 | | 5/2005 | Fujii et al. | |

FOREIGN PATENT DOCUMENTS

| | | | |
|---|---|---|---|
| DE | 19904587 | * | 8/2000 |
| EP | 246923 | * | 11/1987 |

(Continued)

*Primary Examiner*—Ismael Izaguirre
(74) *Attorney, Agent, or Firm*—Faegre & Benson LLP

(57) ABSTRACT

A cordless ironing apparatus includes an iron and an ironing board adapted to be used with the iron. The iron includes a soleplate. The ironing board includes an ironing surface on which fabric is placed and an electromagnetic generator. The electromagnetic generator is adapted to generate an electromagnetic field which generates heat in the soleplate of the iron. Alternatively, the ironing apparatus includes an iron and an induction device which is removable or separate from an ironing board. The induction device includes an electromagnetic generator which is adapted to generate an electromagnetic filed which generates heat in the soleplate of the iron.

16 Claims, 14 Drawing Sheets

FOREIGN PATENT DOCUMENTS

| | | | | |
|---|---|---|---|---|
| GB | 2392171 | | * | 2/2004 |
| JP | 401151497 | | * | 6/1989 |
| JP | 402099099 | A | * | 4/1990 |
| JP | 402109599 | | * | 4/1990 |
| JP | 02220699 | A | * | 9/1990 |
| JP | 403023900 | | * | 1/1991 |
| WO | WO 88/03579 | | * | 5/1988 |
| WO | WO 02/31254 | | * | 4/2002 |

* cited by examiner

INDUCTION IRONING APPARATUS AND METHOD

PRIORITY CLAIM

The present application claims the benefit of U.S. provisional patent application 60/797,678, filed May 5, 2006 and of U.S. provisional patent application 60/800,050, filed May 15, 2006, both of which are hereby incorporated by reference.

TECHNICAL FIELD

The invention relates to a cordless ironing apparatus heated by induction and to a method of using the present cordless ironing apparatus.

BACKGROUND OF THE INVENTION

In a typical induction heating apparatus, an alternating current of a high frequency is made to flow through an induction heating coil to generate a high frequency magnetic field. This high frequency magnetic field produces an eddy current in the object to be heated when the object is placed in the vicinity of the magnetic field heat. The object is heated by Joule heat caused by the eddy current.

BRIEF SUMMARY OF THE INVENTION

The present invention relates to an ironing apparatus comprising an iron including a soleplate and an electromagnetic generator adapted to induce an electromagnetic field that heats the soleplate. In one embodiment, the electromagnetic generator is an electromagnet that is disposed under the ironing surface of an ironing board. The soleplate of the iron is heated through induction. In another embodiment, an ironing system includes an ironing board, an iron including a soleplate, and an electromagnetic generator retained in a docking station with a docking port sized to receive the soleplate. The docking station may be integral to the ironing board or it may be releasably attached.

A further embodiment of the invention includes an ironing system comprising an iron including a soleplate and an electromagnetic generator retained in a docking station with a docking port sized to receive the soleplate.

A method of operating the ironing system includes generating an oscillating electromagnetic field, locating a soleplate on an iron in proximity to the electromagnetic field, and inducing heat in the soleplate until a desired temperature is achieved. Finally, an ironing apparatus including an iron having a body and a heat plate and an electromagnetic generator embedded within the body is described.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
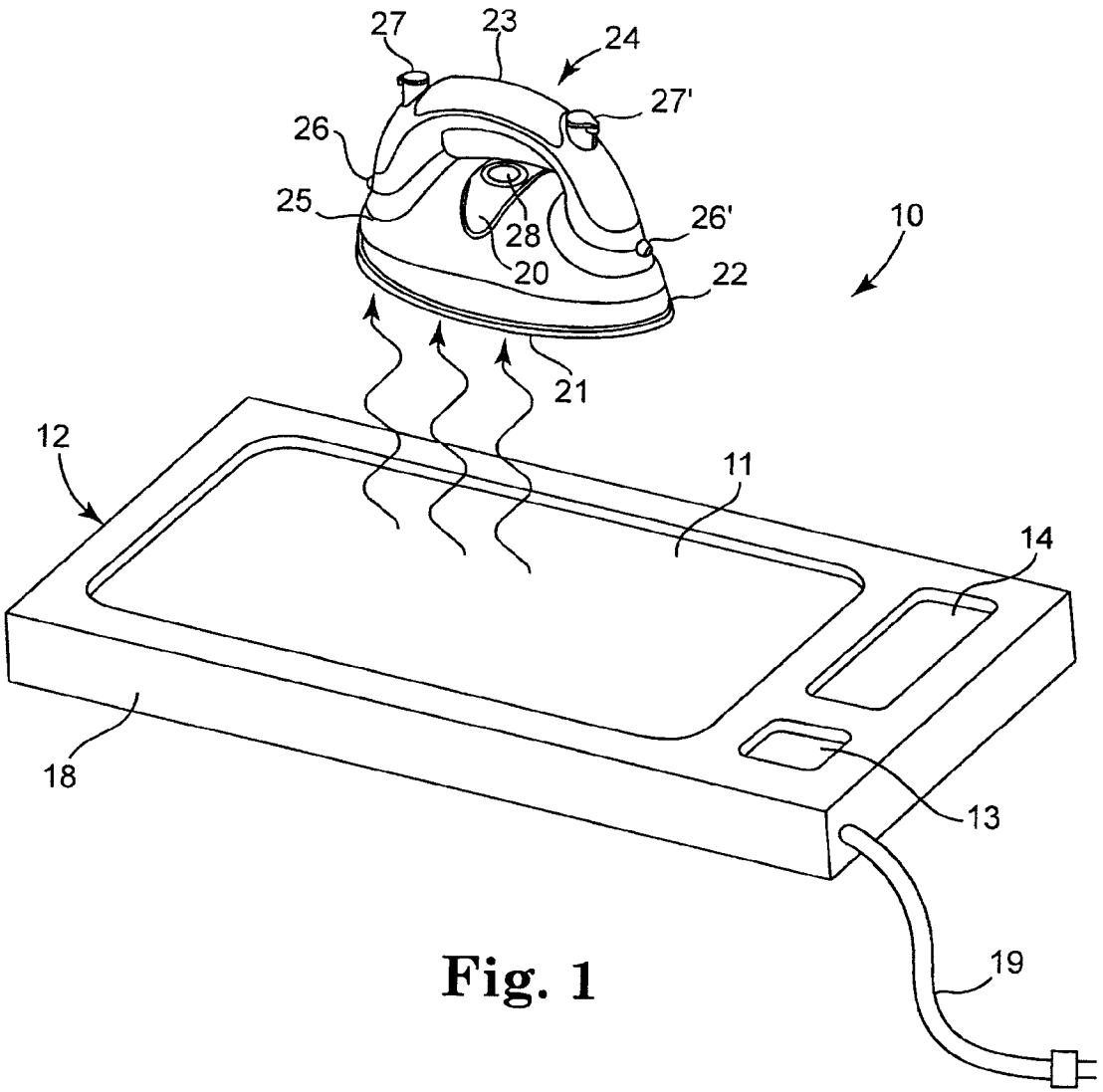
FIG. 1 is a perspective view of an ironing apparatus in accordance with the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION OF THE INVENTION

Referring now to FIG. 1, an embodiment of an ironing apparatus 10 includes a cordless iron 24 and an ironing board 12 in accordance with the present invention. In the embodiment shown in FIG. 1, the ironing board 12 includes an ironing surface 11, a control panel 13 installed in the ironing board 12, a docking port 14, and a housing 18. The ironing surface 11 can be made of ceramic or a high-temperature resistant thermoplastic or thermosetting material, such as phenolic resin, glass, nylon, PBT, or PET. The ironing board 12 can be rectangular or any other shape which is convenient for a user to iron fabric. Additionally, the ironing board 12 can be sized to any dimension such that it is convenient for a user to operate the iron 24. The housing 18 can be made of any suitable material.

In one embodiment, the ironing board 12 includes an optional power cord 19 that is plugged into an external power source such as a wall outlet. Alternatively, the ironing board 12 is cordless and includes a rechargeable battery allowing for a completely cordless ironing apparatus 10. The cordless features of the ironing apparatus 10 allow for easy storage and portability, and for the ironing apparatus 10 to be placed on any flat surface for the convenience of the user.

Figure 2A:
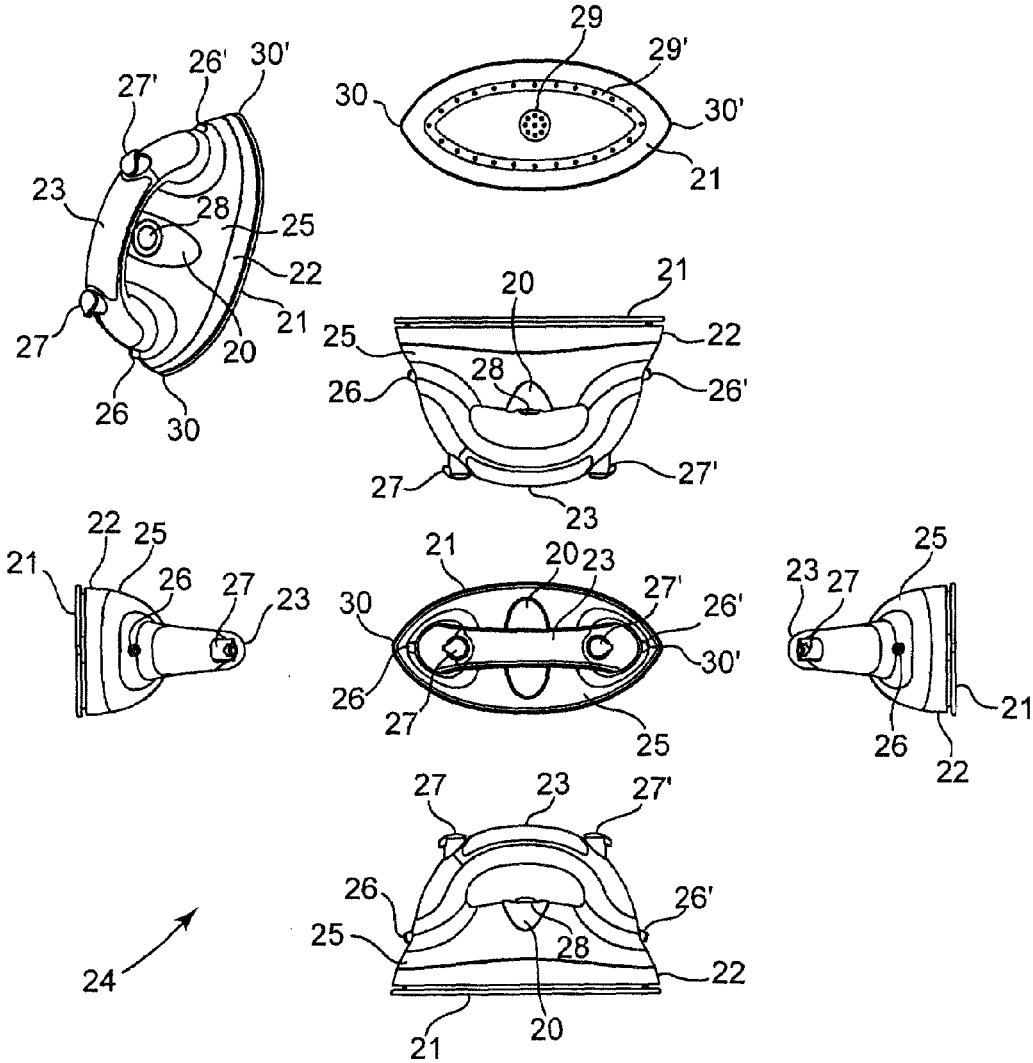
FIG. 2A shows multiple views of an iron that can be used in various embodiments of the present invention.
Figure 2B:
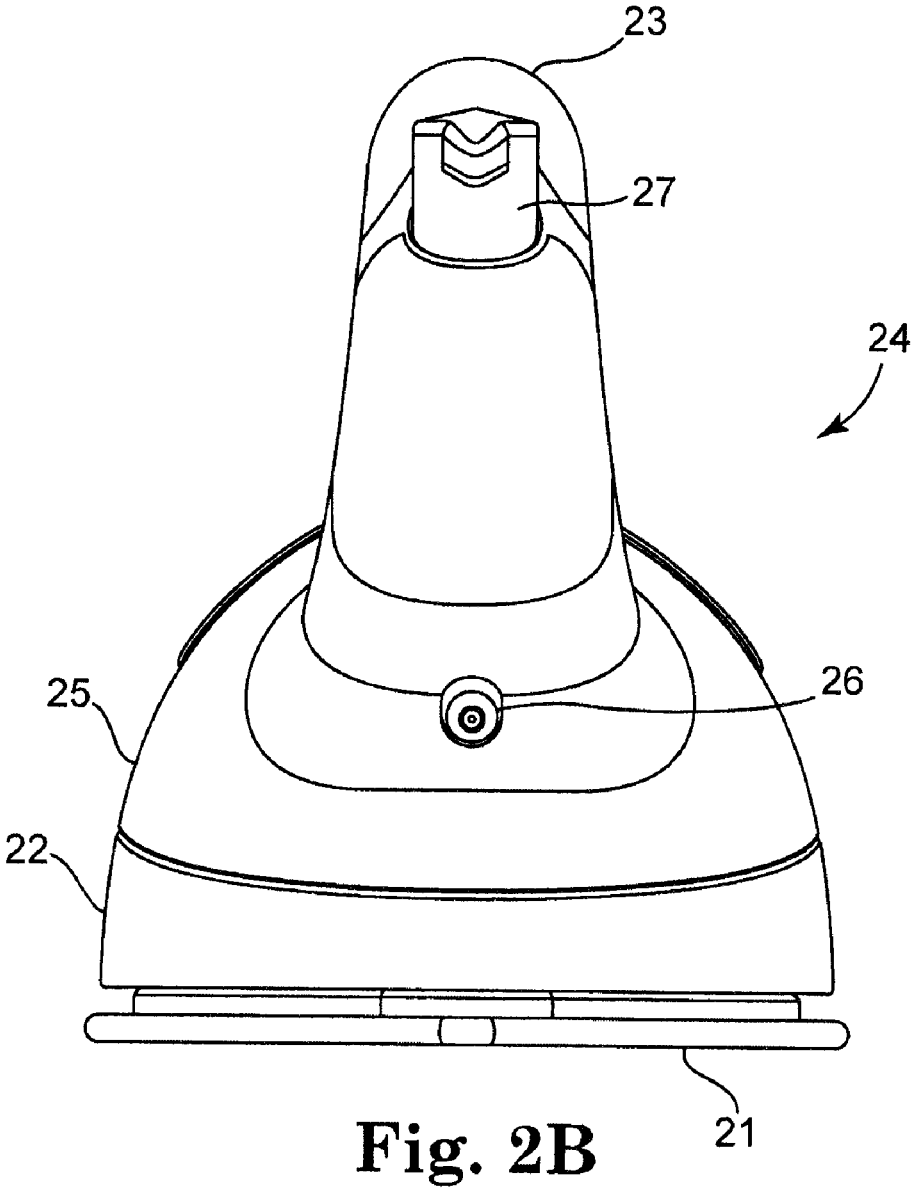
FIG. 2B is a front view of an iron that can be used in various embodiments of the present invention.

FIG. 2A shows multiple views of the cordless iron 24 shown in FIG. 1. FIG. 2B shows a front view of the iron 24 shown in FIG. 1. The iron 24 includes a handle 23, a body 25, a mounting support 22, and a soleplate 21 mounted on the mounting support 22. FIG. 2A also shows powerful steam activating buttons 27 and 27' and steam spray nozzles 26 and 26' located proximate to tips 30 and 30' of the soleplate 21 for delivering a burst of powerful steam to the article to be ironed.

In the embodiment of FIG. 2A, the handle 23 is symmetrical and is oriented along a longitudinal axis of the soleplate 21. This allows for either a right-handed user or a left-handed user to comfortably move the iron 24 back and forth over a fabric or article of clothing placed on an ironing surface such as the one illustrated in FIG. 1.

The soleplate 21 is mounted on the mounting support 22. The soleplate 21 is preferably symmetrical and includes tips 30 and 30' located on its longitudinal ends. In one embodiment the soleplate 21 is releasably attached to the mounting support 22. The soleplate 21 is made of a ferrous metal such as iron or stainless steel. Alternatively, the soleplate 21 may be made of a ferrous alloy or a ferromagnetic ceramic. As technology progresses, the soleplate 21 can be made of other suitable materials such as aluminum or copper and their respective alloys. The soleplate also may include at least one set of steam holes 29 and 29' for providing steam during ironing.

In an alternate embodiment of the invention illustrated in FIGS. 1 and 2A and 2B, the cordless iron 24 includes a water tank 20 to provide steam. A normal steam activating button 28 is provided on the water tank 20 and below the handle 23. Neither a heating element nor a temperature control is required in the cordless iron 24. This allows more room for a larger water tank and steam chamber for vaporization. Steam is desirable when ironing such fabrics as linen, cotton, wool, and their respective blends. A burst of normal steam is provided through steam hole set 29' when the normal steam activating button 28 provided on the water tank 20 is actuated. Steam is provided through steam hole set 29 when either powerful steam activating button 27 or 27' is actuated by a user. Powerful steam activating buttons 27 and 27' are adapted to select between delivering a burst of steam or powerful steam to the article to be ironed.

The cordless iron 24 can serve as a dry iron. Dry irons are used for smoothing such fabrics as silk, rayon, acetate, nylon and their respective blends or for ironing on patches or other adhesive articles.

Figure 3:
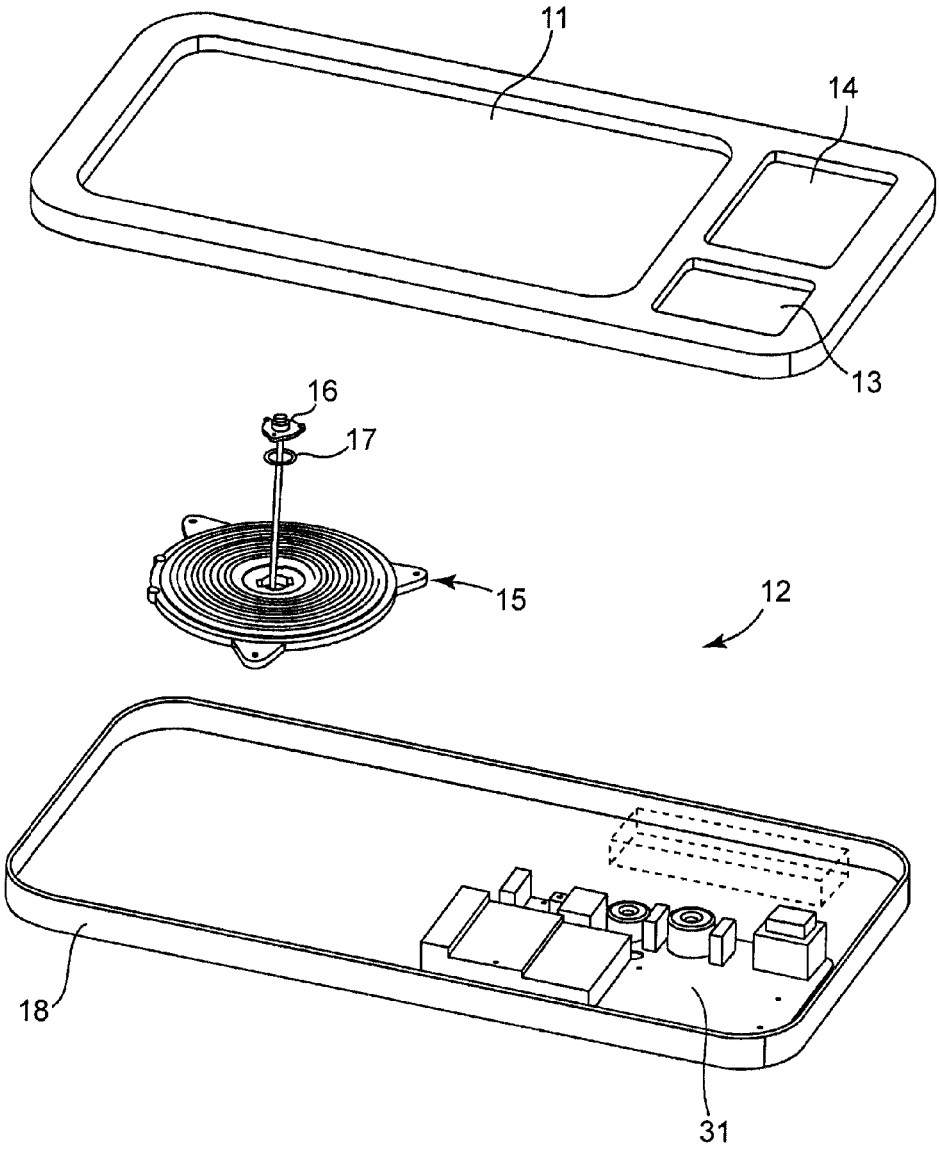
FIG. 3 is an exploded view of an ironing board of the ironing apparatus of FIG. 1.

As best illustrated in FIG. 3, an electromagnetic generator 15 adapted to generate an electromagnetic field is disposed within the ironing board 12. In the embodiment illustrated in FIG. 3, the electromagnetic generator 15 is disposed within the housing 18 under the ironing surface 11. Preferably, the electromagnetic generator 15 is a powerful, high-frequency electromagnet. An electromagnetic field is generated when oscillating current (AC) is supplied to the electromagnet from a power source. The frequency of the oscillating current supplied to the electromagnetic generator 15 ranges from 15 kHz to 80 kHz. Preferably, the frequency ranges from 20 kHz to 30 kHz. The frequency of the oscillating current can be adjusted depending on the material selected for the soleplate 21 of the iron 24. A digital or analog controller 31 adapted to control the operation of the electromagnetic generator 15 is also disposed in the ironing board 12. In the event that the ironing board 12 is cordless, a rechargeable battery is preferably also located within the ironing board 12. The electromagnetic generator 15 can be of any appropriate shape and size depending on the shape and size of the ironing board 12.

Referring to FIGS. 1 and 3, when the soleplate 21 of the iron 24 is placed in proximity to an electromagnetic field (represented by the sinusoidal lines in FIG. 1) generated by the electromagnetic generator 15, the electromagnetic field transfers energy into the metal of the soleplate 21 through a process known as induction. The transferred energy causes the metal of the soleplate 21 to become hot. In particular, the electromagnetic field penetrates the metal of the soleplate 21 and generates a circulating electric current, generating heat in the soleplate 21. The heat is generated directly in the soleplate 21 of the iron 24 itself. The ironing board 12 is preferably constructed of materials that are not heated when exposed to electromagnetic field. No physical contact is required between the soleplate 21 and the electromagnetic generator 15 in order for heat to be induced in the soleplate 21.

The electromagnetic generator 15 can continuously heat the soleplate 21 of the iron 24, as long as the soleplate 21 of the iron 24 remains in proximity to the electromagnetic field. In the embodiment shown in FIG. 1, the soleplate 21 of the iron 24 is in the electromagnetic field when it is held in proximity to or is directly placed on the ironing surface 11. When the iron 24 is removed from the electromagnetic field created by the electromagnetic generator 15, the circulating electric current subsides and the soleplate 21 cools.

By controlling the strength and/or duration of the electromagnetic field, the amount of heat being generated in the soleplate 21 of the iron 24 can be controlled. In one embodiment, the strength of the electromagnetic field is adjusted by adjusting the frequency of the current supplied to the electromagnetic generator 15.

As illustrated in FIG. 3, a thermal sensor 16 is mounted on a support and placed at the center of the electromagnetic generator 15. The thermal sensor 16 communicates with the bottom of the ironing surface 11 through a spring 17. The thermal sensor 16 communicates the temperature of the soleplate 21 of the iron 24 to the controller 31 also disposed within the ironing board 12. The controller 31 may be digital or analog and communicates with the control panel 13 located on the surface of the ironing board 12 illustrated in FIG. 1. The controller 31 adjusts the strength and/or duration of the electromagnetic field generated by the electromagnetic generator 15 in response to a temperature selection made by a user through the control panel 13. The control panel 13 may also include an alarm or indicator light to alert the user that the soleplate 21 has reached a select temperature. Additionally, it may include an automatic shut off device that interrupts the power supply to the electromagnetic generator 15 if the iron 24 has not been in use for a specified amount of time.

Figure 4A:
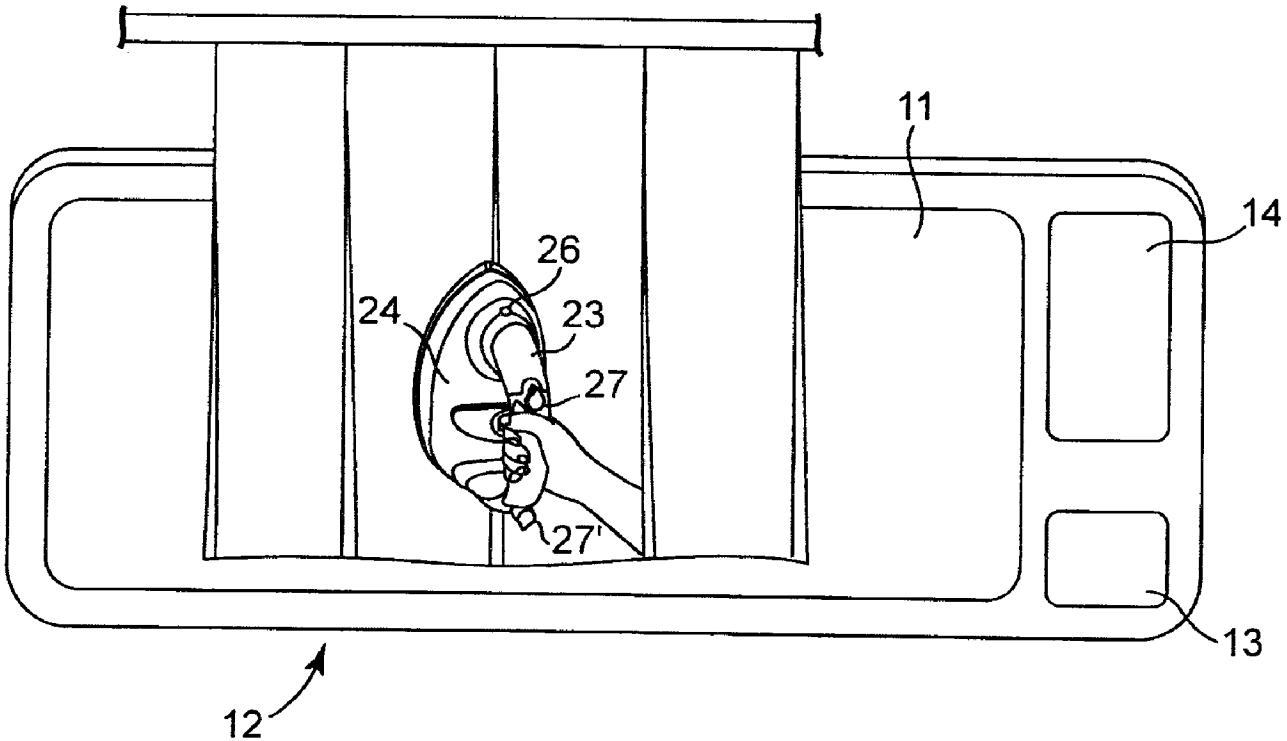
FIGS. 4A, 4B and 5 illustrate various methods of using the iron illustrated in FIGS. 2A and 2B.
Figure 4B:
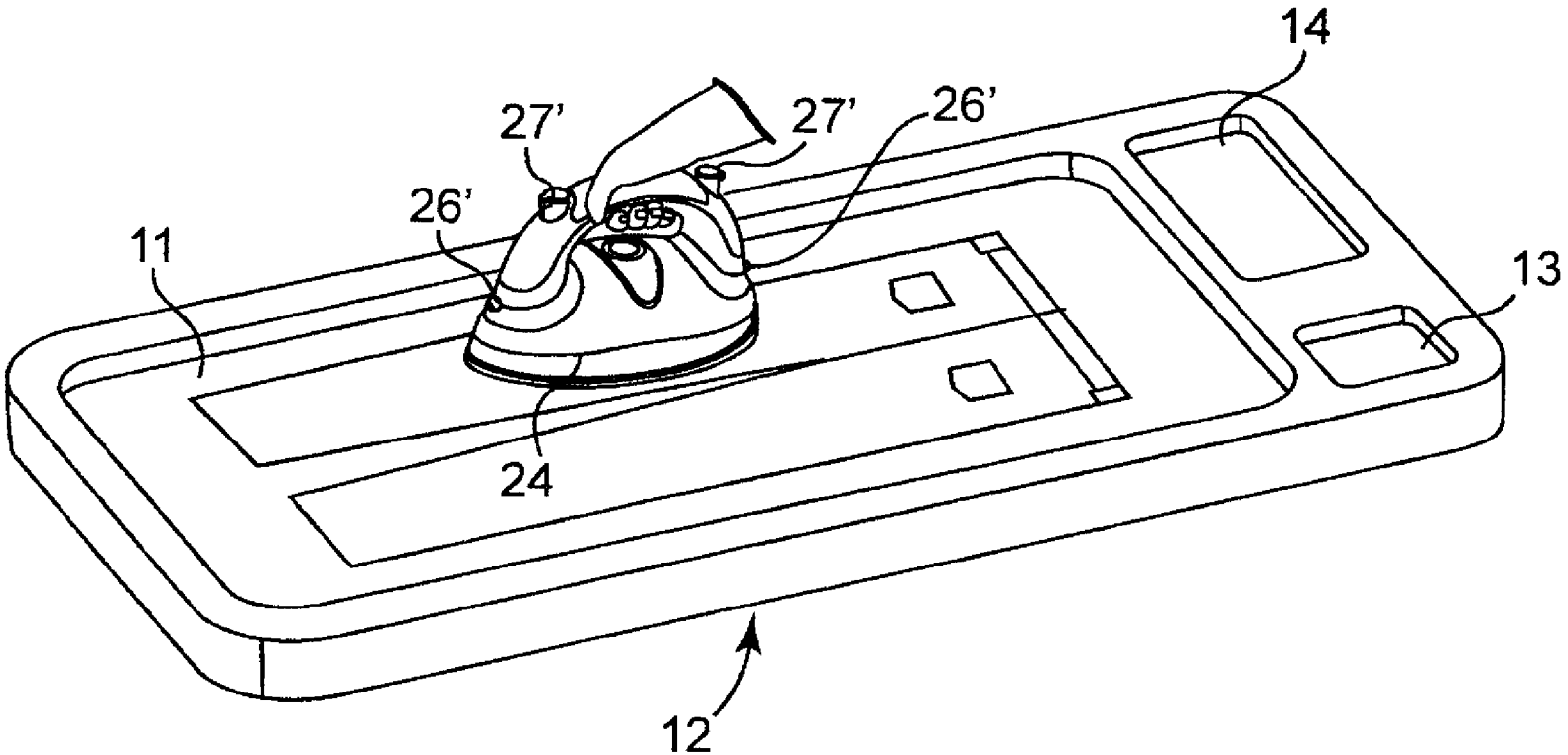
Figure 5:
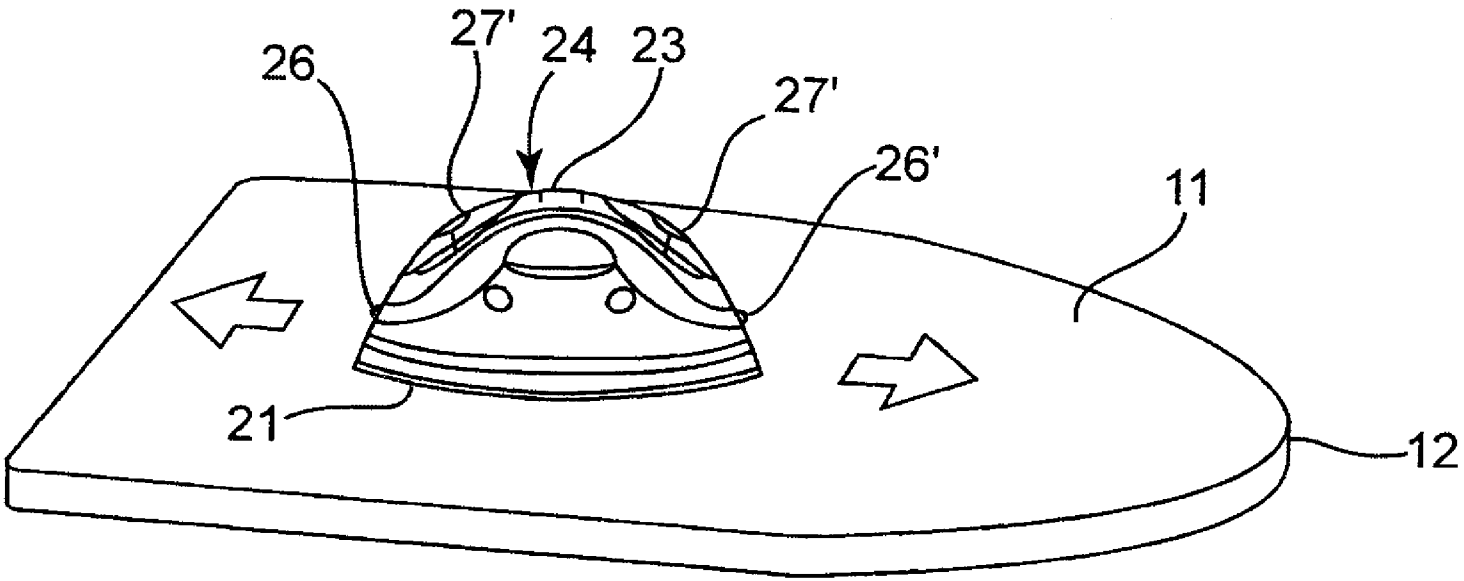

FIGS. 4A, 4B and 5 show various methods of using the ironing apparatus 10 illustrated in FIGS. 1-3. Fabric or an article of clothing is placed on the ironing surface 11. The iron 24 is removed from the docking port 14 by a user and placed in proximity to the electromagnetic generator 15 located under the ironing surface 11. When the iron 24 reaches a desired temperature communicated by the control panel 13 located on the surface of the ironing board 12, ironing may proceed by moving the iron 24 back and forth on the fabric or article of clothing. Movement does not need to occur along the longitudinal axis of the ironing board 12. When the user is finished, the iron 24 can be placed on the docking station 14 and allowed to cool. If the iron 24 includes the optional water tank 20, the user can actuate either a powerful steam activating button 27 or a normal steam activating button 28 to release steam through steam hole sets 29 or 29'.

Figure 6:
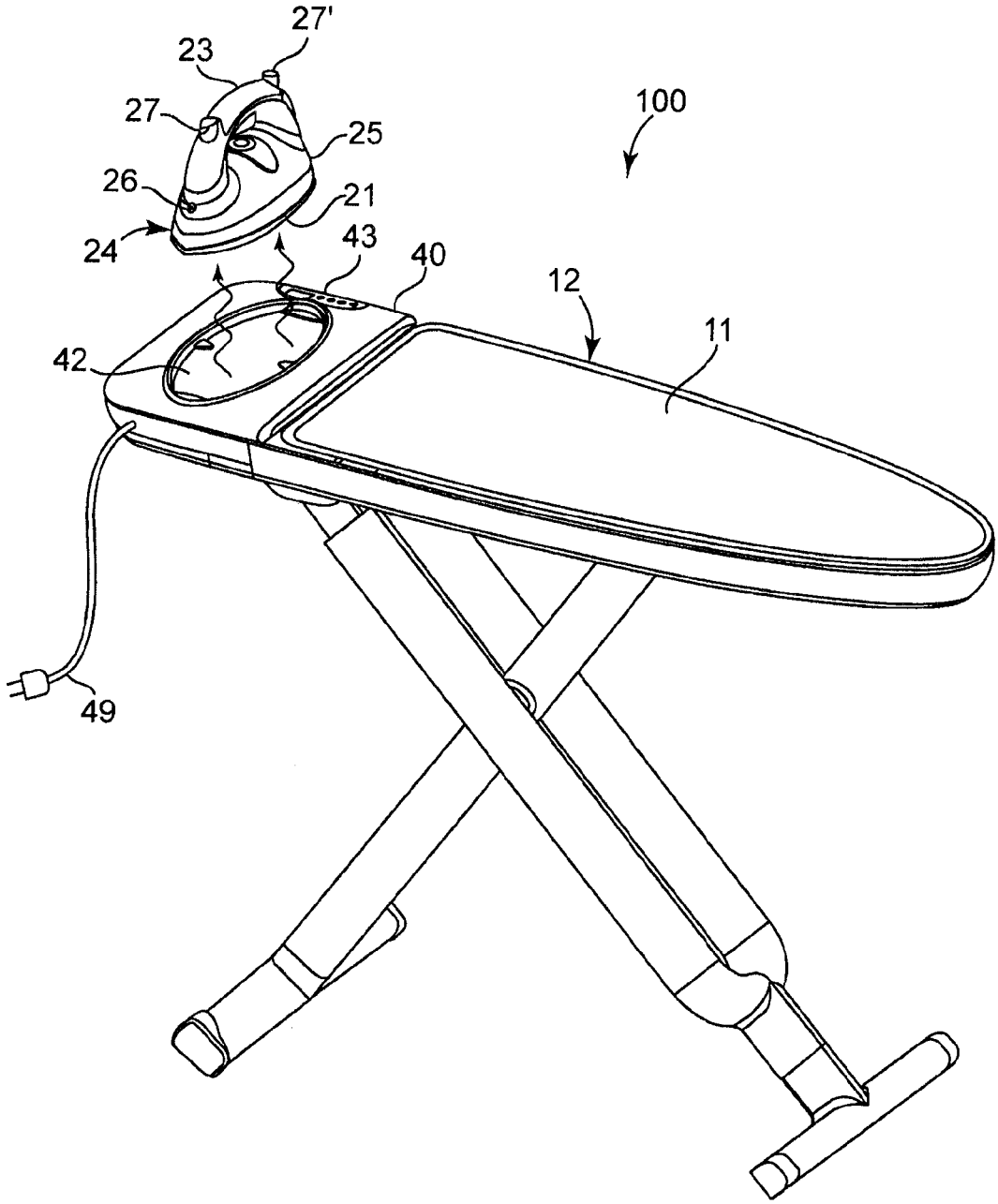
FIG. 6 shows an alternate embodiment of an ironing apparatus having an iron, a docking station, and an ironing board in accordance with the present invention.
Figure 7:
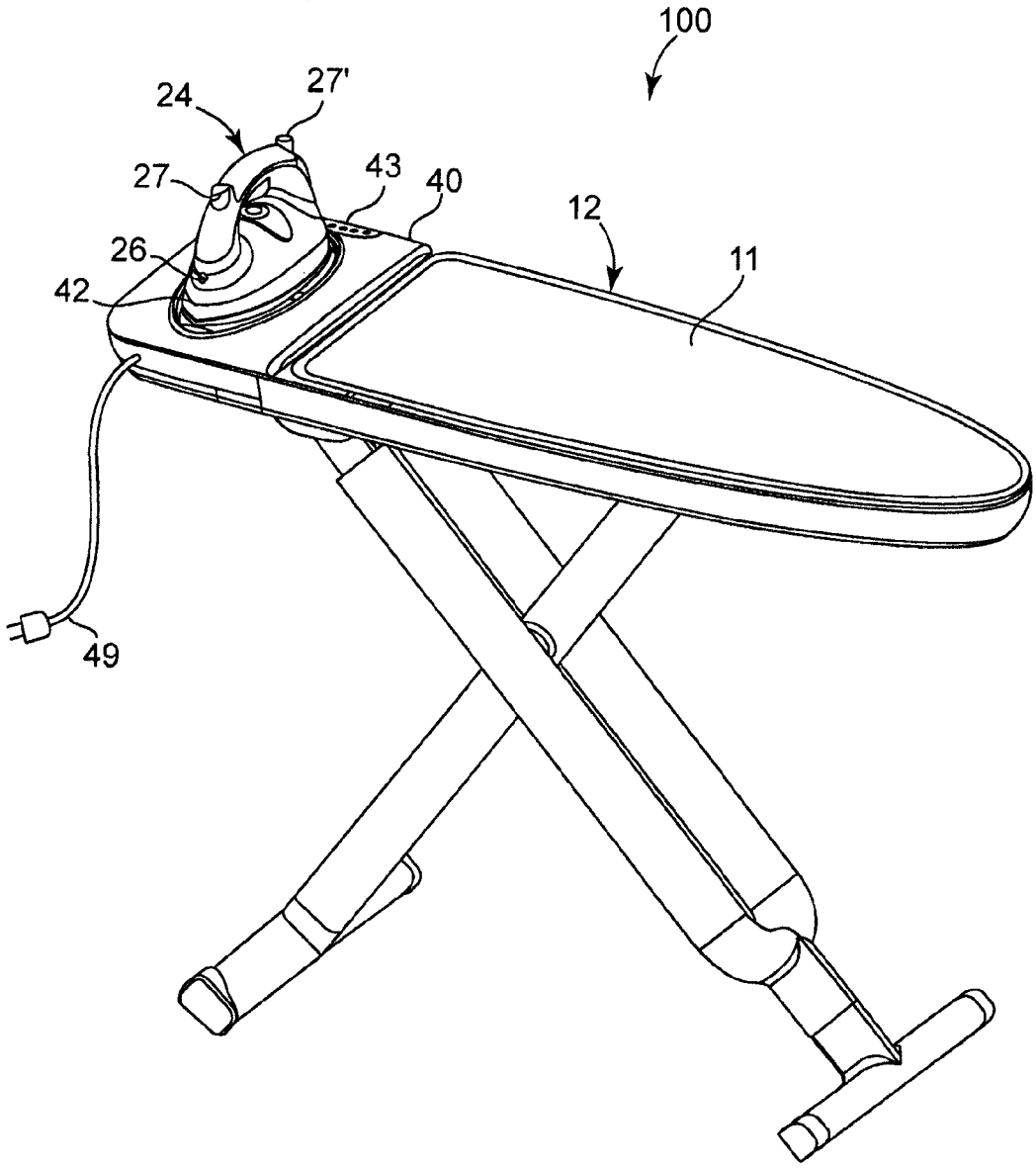
FIG. 7 shows the embodiment of the ironing apparatus of FIG. 6 with the iron received in a docking port of the docking station of the ironing apparatus in accordance with the present invention.
Figure 8:
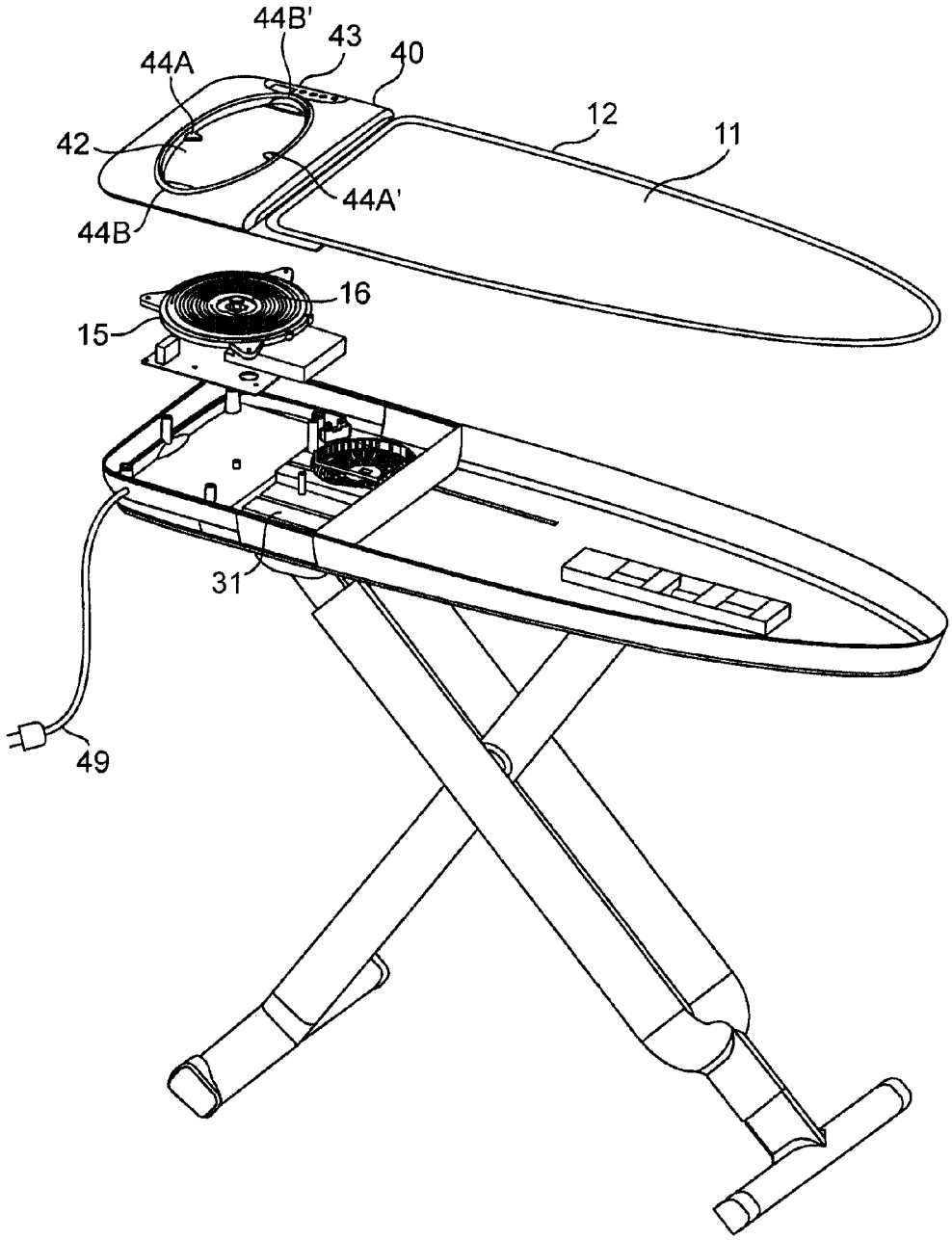
FIG. 8 is an exploded view of the embodiment of the ironing apparatus shown in FIG. 6.

Referring now to FIGS. 6-8, an embodiment of an ironing apparatus 100 includes a cordless iron 24 such as the one illustrated in FIG. 2, an ironing board 12, and a docking station 40. The docking station 40 includes a docking port 42 and a control panel 43. The ironing board 12 can be any shape or size which is convenient for a user to iron fabric or clothing. The ironing board 12 includes an ironing surface 11 on which fabric or an article of clothing is placed. The ironing surface 11 is made from a ceramic or other high-temperature resistant thermoplastic or thermosetting material, such as phenolic resin, glass, nylon, PBT, PET, or wood. In one embodiment, the docking station 40 is integral to the ironing board 12. Alternatively, the docking station 40 is releasably attached to the ironing board 12.

The docking station 40 includes a docking port 42 sized to receive the cordless iron 24. The docking port 42 is made from a ceramic or another suitable high-temperature resistant material such as for example phenolic resin, glass, nylon, PBT, or PET. When placed in the docking port 42, the iron 24 rests on braces 44A, 44A', 44B, and 44B' (referred to collectively as "44"). The iron 24 is placed in the docking port 42 for heating the soleplate 21. The iron 24 also may rest or cool in the docking port 42 when the ironing apparatus is no longer in use.

In one embodiment according to the present invention, one or more of the braces 44 is a pressure switch that signals the controller 31 to activate the electromagnetic generator 15. When the cordless iron 24 is removed, the pressure switch 44 signals the controller 31 to deactivate the electromagnetic generator 15.

As illustrated in FIG. 8, the docking station 40 includes a power source 49 and an electromagnetic generator 15 adapted to generate an electromagnetic field. The docking station 40 also includes a control panel 43 located on the its surface for displaying and selecting an operating temperature of the soleplate 21 of the cordless iron 24. In the illustrated embodiment, the power source 49 is a power cord adapted to be connected to a wall outlet. Alternatively, the power source is a rechargeable battery located within the docking station 40. The electromagnetic generator 15 includes a powerful, high-frequency electromagnet. An electromagnetic field is generated by the electromagnet when oscillating current (AC) is supplied from a power cord 49, as illustrated, or a rechargeable battery. The electromagnetic generator 15 is disposed under the docking port 42 of the docking station 40. A digital or analog controller 31 for controlling the operation of the electromagnetic generator 15 is also disposed in the docking station 40. The controller 31 communicates with the control panel 43.

When the soleplate 21 of the cordless iron 24 is placed in proximity to the electromagnetic field generated by the electromagnetic generator 15, the electromagnetic field transfers energy into the metal of the soleplate 21 through induction. The transferred energy causes the metal of the soleplate 21 to become hot. In particular, the electromagnetic field penetrates the metal of the soleplate 21 and generates a circulating electric current, generating heat in the soleplate 21. The heat is generated directly in the soleplate 21 of the iron 24 itself, not in any part of the docking station 40.

The electromagnetic generator 15 continuously heats the soleplate 21 of the iron 24, as long as the soleplate 21 of the cordless iron 24 remains in proximity to the electromagnetic field. When the iron 24 is removed from the electromagnetic field, the soleplate 21 of the iron 24 begins to cool. In the illustrated embodiment, the soleplate 21 of the iron 24 is in the electromagnetic field when it is placed in the docking port 42 of the docking station 40 and power is being supplied to the electromagnetic generator 15.

By controlling the strength and/or duration of the electromagnetic field, the amount of heat being generated in the soleplate 21 of the cordless iron 24 can be controlled. As illustrated in FIG. 8, a thermal sensor 16 adapted to communicate the temperature of the soleplate 21 of the iron 24 to the controller 31 is installed in the docking station 40. In one embodiment, the thermal sensor 16 is mounted on a support and placed at the center of the electromagnetic generator 15. The thermal sensor 16 communicates with the bottom of the ironing surface 11 through a spring 17. The thermal sensor 16 communicates the temperature of the soleplate 21 of the iron 24 to the controller 31 also installed in the ironing board 12. The controller 31 may be digital or analog and communicates with the control panel 43. The controller 31 adjusts the strength of the electromagnetic field in response to a temperature selection made by a user through the control panel 43 by adjusting the frequency of the current supplied to the electromagnetic generator 15. The control panel 43 may include an alarm or indicator light to alert the user that the soleplate 21 has reached a select temperature. Additionally, it may include an automatic shut off device that interrupts the power supply to the electromagnetic generator 15 if the iron 24 has not been in use for a specified amount of time.

In use, when the docking station 40 is powered, the electromagnetic generator 15 starts to generate an electromagnetic field. The soleplate 21 of the cordless iron 24 placed in the docking station 42 of the docking station 40 becomes heated to a desired temperature selected by a user through the control panel 43. The user then places the iron 24 on the ironing board 12 and moves the iron 24 back and forth on a fabric laid on the ironing surface 11 of the ironing board 12. The soleplate 21 of the iron 24 cools down as the ironing process continues. The soleplate 21 can be reheated when it is placed in the docking station 42 of the induction device 12.

Figure 9:
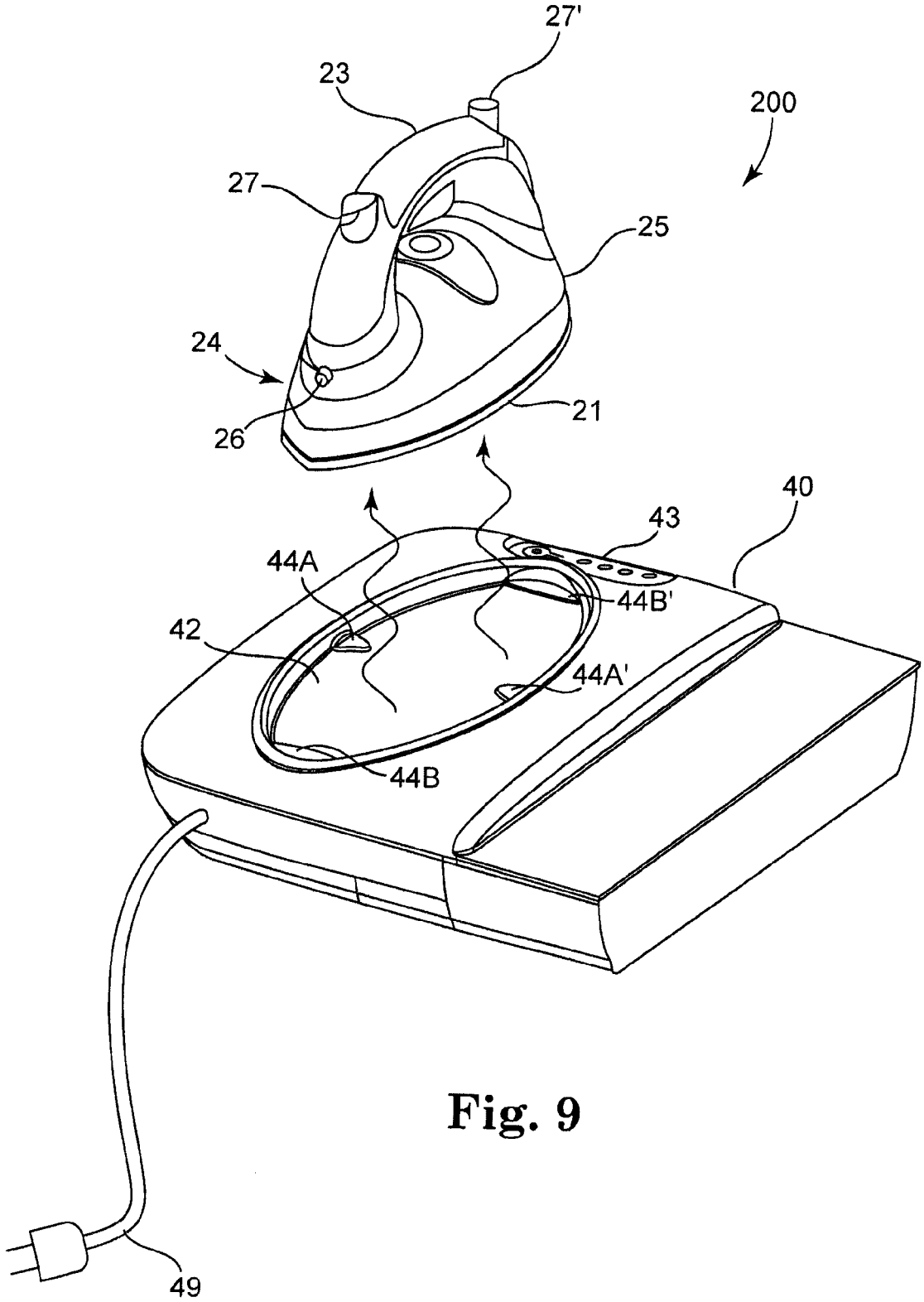
FIG. 9 shows another embodiment of an ironing apparatus including an iron and a docking station in accordance with the present invention.
Figure 10:
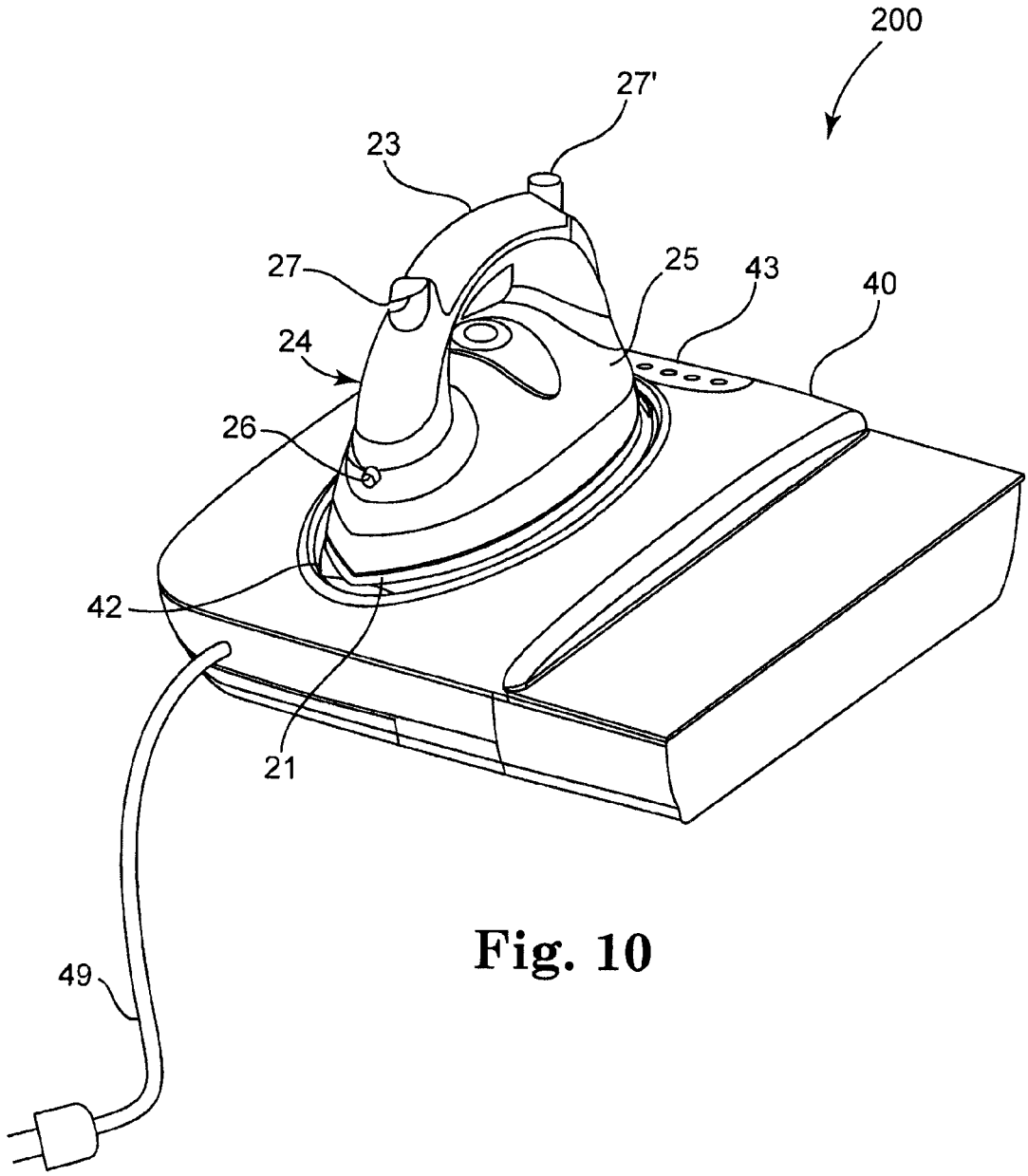
FIG. 10 shows the embodiment of the ironing apparatus of FIG. 9 with the iron placed in a docking port of the docking station in accordance with the present invention.
Figure 11:
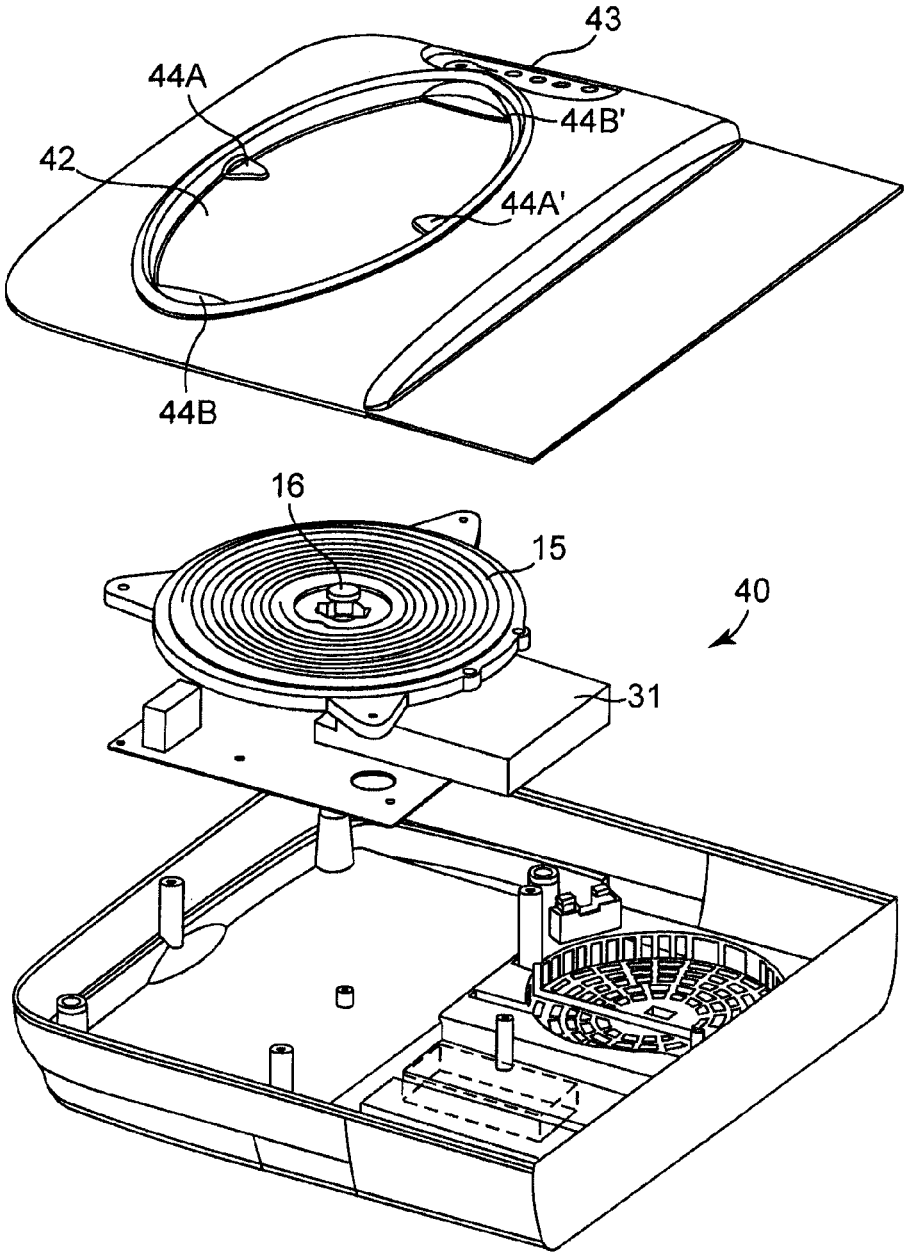
FIG. 11 is an exploded view of the embodiment of the ironing apparatus of FIG. 9.

The ironing board 12 of the ironing apparatus 100 is optional. FIGS. 9-11 show yet another embodiment of an ironing apparatus 200 which includes a cordless iron 24 and a docking station 40. The heated iron 24 can be used to iron fabric on a separate ironing board. Alternatively, it may be used to steam fabric or an article of clothing that is hanging. The structures and functions of the cordless iron 24 and docking station 40 are similar to the iron 24 and the docking station 40 discussed and illustrated in FIGS. 2A, 2B, and 8. The ironing apparatus 200 also includes a power source such as a power cord 49, as illustrated, adapted to be connected to a wall outlet or a rechargeable battery located within the docking station 40. The rechargeable battery is shown in phantom in FIG. 11.

Figure 12:
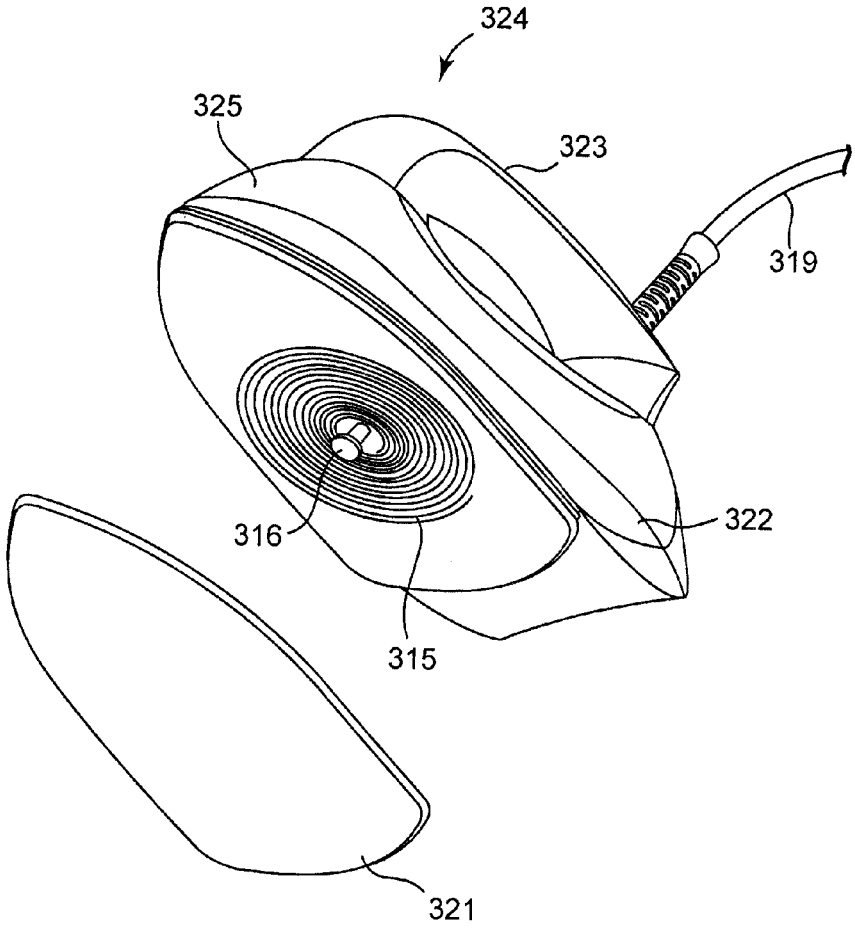
FIG. 12 shows another embodiment of the invention including an iron and an induction device embedded in the body of the iron.

FIG. 12 shows yet another embodiment of the invention including an iron 324 and an electromagnetic generator 315 embedded in the iron body 325. Power is supplied to the electromagnetic generator 315 by a power cord 319 adapted to plug into an external power source such as a wall outlet. A digital or analog controller (not shown) is located in the body 325 of the iron and communicates to a control panel located either on the iron body 325 or the iron handle 323. The iron 324 includes a thermal sensor 316 in contact with the surface of the soleplate 321. The thermal sensor 316 communicates the temperature of the soleplate 321 of the iron 324 to the controller. The controller adjusts the strength of the electromagnetic field in response to a temperature selection made by a user through the control panel by adjusting the frequency of the current supplied to the electromagnetic generator 315. This controls the temperature of the soleplate 321. The control panel may include an alarm or indicator light that alerts the user that the soleplate 321 has reached a selected temperature. Additionally, the control panel may include a automatic shut off device that interrupts the power supply to the electromagnetic generator 315 if the iron 324 has not been in use for a specified amount of time.

While there have been described and pointed out fundamental novel features of the invention as applied to a preferred embodiment thereof, it will be understood that various omissions, substitutions and changes, in the form and details of the embodiments illustrated, may be made by those skilled in the art without departing from the spirit of the invention. The invention is not limited by the embodiments described above which are presented as examples only but can be modified in various ways within the scope of protection defined by the appended patent claims.

What is claimed is:

1. An ironing apparatus comprising:

an iron comprising: a soleplate having a first axis oriented along a major dimension of the soleplate, a second axis perpendicular to the first axis and oriented along a minor dimension of the soleplate, wherein the soleplate is symmetrical along both the first and second axes, and a first tip and a second tip located at opposite ends of the soleplate along the first axis; a water tank; a symmetrical handle oriented and aligned in a direction along the first axis of the soleplate, a first steam activating button and a first spray nozzle located proximate to a first tip of the soleplate; and a second steam activating button and a second steam spray nozzle located proximate to a second tip of the soleplate;

an electromagnetic generator in displaceable electromagnetic communication with the soleplate, adapted to induce an electromagnetic field that heats the soleplate;

wherein said soleplate is heated when said soleplate is placed in electromagnetic communication with said generator; and wherein said soleplate is not heated when said soleplate is not placed in electromagnetic communication with said generator.

2. The ironing apparatus of claim 1, wherein the electromagnetic generator is retained in a docking station with a docking port sized to releasably receive the soleplate.

3. The ironing apparatus of claim 1, wherein said soleplate is releasably attached to the iron.

4. The ironing apparatus of claim 1, further comprising a set of steam holes located on the soleplate for delivering a burst of normal steam.

5. The ironing apparatus of claim 1, wherein the electromagnetic generator comprises a high-frequency electromagnet.

6. The ironing apparatus of claim 1, further comprising an ironing surface, wherein the electromagnetic generator is disposed under the ironing surface.

7. The ironing apparatus of claim 1, wherein the electromagnetic generator comprises a thermal sensor.

8. The ironing apparatus of claim 1, wherein the electromagnetic generator comprises a controller coupled to a thermal sensor adapted to control the temperature of the soleplate.

9. The ironing apparatus of claim 1, wherein the electromagnetic generator comprises one or more of a power cord or a rechargeable battery.

10. The ironing apparatus of claim 1, wherein the iron is cordless.

11. An ironing system, comprising:

an ironing board attached to a docking station;

an iron comprising: a soleplate having a first axis oriented along a major dimension of the soleplate, a second axis perpendicular to the first axis and oriented along a minor dimension of the soleplate, wherein the soleplate is symmetrical along both the first and second axes, and a first tip and a second tip located at opposite ends of the soleplate along the first axis; a water tank; a symmetrical handle oriented and aligned in a direction along the first axis of the soleplate; a first steam activating button and a first spray nozzle located proximate to a first tip of the soleplate; and a second steam activating button and a second steam spray nozzle located proximate to a second tip of the soleplate;

an electromagnetic generator retained in said docking station with a docking port sized to receive the soleplate and in displaceable electromagnetic communication with said soleplate;

wherein said soleplate is heated when said soleplate is placed in electromagnetic communication with said generator; and wherein said soleplate is not heated when said soleplate is not placed in electromagnetic communication with said generator.

12. The ironing system of claim 11, wherein the docking station is releasably attached to the ironing board.

13. The ironing system of claim 11, wherein the electromagnetic generator comprises one or more of a power cord or a rechargeable battery.

14. The ironing system of claim 11, wherein the iron is cordless.

15. A method of operating an ironing system, comprising:

generating an oscillating electromagnetic field;

placing a soleplate of an iron in proximity to the electromagnetic field, wherein the iron comprises a soleplate having a first axis oriented along a major dimension of the soleplate, a second axis perpendicular to the first axis and oriented along a minor dimension of the soleplate, wherein the soleplate is symmetrical along both the first and second axes, and a first tip and a second tip located at opposite ends of the soleplate along the first axis; a water tank; a symmetrical handle oriented and aligned in a direction along the first axis of the soleplate, a first steam activating button and a first spray nozzle located proximate to a first tip of the soleplate; and a second steam activating button and a second steam spray nozzle located proximate to a second tip of the soleplate;

inducing heat in the soleplate until a desired temperature is achieved; and moving said soleplate along a surface in electromagnetic communication with said electromagnetic field.

16. The method according to claim 15, further comprising the step of removing the soleplate from said electromagnetic communication with the oscillating electromagnetic field.

* * * * *